United States Patent [19]

Clayton

[11] Patent Number: 4,777,474

[45] Date of Patent: Oct. 11, 1988

[54] ALARM SYSTEM FOR THE HEARING IMPAIRED

[76] Inventor: Jack A. Clayton, 7444 Dexter Town Hall, Dexter, Mich. 48130

[21] Appl. No.: 36,926

[22] Filed: Mar. 26, 1987

[51] Int. Cl.[4] ..... G08B 1/08

[52] U.S. Cl. ..... 340/539; 340/573; 340/407; 340/531; 340/825.19; 379/38; 379/52; 381/42; 381/60; 381/68; 381/23.1

[58] Field of Search ..... 340/539, 407, 825.19, 340/573,531, 384 E, 384 R, 522; 379/37, 38, 39, 52; 381/60, 68, 58, 42, 23.1, 56, 57; 367/197–199; 434/112

[56] References Cited

U.S. PATENT DOCUMENTS

| | | | |
|---|---|---|---|
| 3,183,509 | 5/1965 | Ellett | 367/197 |
| 3,925,763 | 12/1975 | Wadhwani et al. | 340/539 |
| 3,984,803 | 10/1976 | Hawk et al. | 340/539 |
| 4,297,677 | 10/1981 | Lewis et al. | 340/825.19 |

*Primary Examiner*—Donnie L. Crosland
*Attorney, Agent, or Firm*—Krass and Young

[57] ABSTRACT

The present invention is an alarm for the hearing impaired. A base station includes alarm receiving circuits for receipt of alarm signals. These alarm signals could be a telephone ringing signal, a smoke/fire alarm, a doorbell signal or the like. Upon detection of one of these alarms, a radio transmitter transmits a signal to a portable unit. The portable unit includes all parts of an ordinary hearing aid together with a radio receiver to receive the signal transmitted by the base station. In a first embodiment, the base station includes a tone generator or voice signal generator which generates a unique signal dependent upon the alarm received for modulation of the transmitted signal. The portable unit includes a demodulator for recovery of the original signal. Thus the unse can determine the type of alarm from the audio signal received. In a second embodiment, a tone generator in the portable unit is enabled by the transmitted signal from the base station.

23 Claims, 4 Drawing Sheets

ALARM SYSTEM FOR THE HEARING IMPAIRED

FIELD OF THE INVENTION

The field of the present invention is that of alarm systems and in particular alarm systems adapted for use by the hearing impaired.

BACKGROUND OF THE INVENTION

In a normal home environment a number of systems rely upon the use of audible alarms. Examples of such systems are the telephone, the doorbell and smoke or fire alarms. Such audible alarms are difficult to detect by hearing impaired persons, even when using an ordinary hearing aid.

It has heretofore been proposed to provide visual signals for such alarm conditions. For example, a special device can be attached to the telephone in order to illuminate a lamp when the telephone rings. Such visual alarms are detectable by hearing impaired persons but do involve problems. The hearing impaired person is not always in an area where the visual alarm can be observed. In addition, even if the hearing impaired person is within the area where the visual alarm can be observed, momentary diversion of visual attention can prevent the hearing impaired person from detecting the alarm.

There is therefore a need to provide some manner in which a hearing impaired person can reliably receive an audible alarm signal.

SUMMARY OF THE INVENTION

The present invention is a two-part alarm system for use by hearing impaired persons. The first part is a base station which is connected to various alarming devices to receive an indication when such an alarm has been issued. This base station then transmits a radio signal indicative of the alarm condition. The second portion of the invention is a portable unit which is preferably embodied in the same housing as a normal hearing aid. This portable unit includes a radio receiver for receiving the radio signal generated by the base station. The detected signal from this radio receiver is coupled to the normal hearing aid circuit so that an alarm signal is generated in the hearing aid earphone. Therefore, the hearing impaired person is alerted to a particular alarm condition.

In accordance with the preferred embodiment of the present invention, the base portion of the two-part alarm device includes visual indicators. These visual indicators are associated with particular alarming devices. Thus, for example, the user being alerted by the reception of an audible signal through the hearing aid portion of the system can observe the visual indicators at the base portion to learn the exact nature of the alarm. In the preferred embodiment, each of these visual indicators include a reset device for resetting the visual indicator to the non-actuated state. This can be done by the user once he understands the nature of the alarm. In a further feature of the preferred embodiment, the base portion of the system includes an alarm test device. Actuation of the alarm test device causes generation of the radio signal by the base portion. The user can then listen to the hearing aid portion of the system and confirm whether or not the alarm system is properly operating.

In accordance with the preferred embodiment of the present invention, the base station includes an audio signal generator device which modulates the radio signal generated by the base station. Thus the user can detect this modulated signal as an audio signal in the earphone. It is preferable that the audio signal generator generate differing tone signals for each differing alarm condition. These differing tone signals could include differences in the amplitude or frequency modulation of the tone signal. By this means the nature of the tone received by the hearing impaired user during generation of an alarm signal indicates which condition has triggered the alarm.

In accordance with an alternative embodiment, the audio signal generator can be embodied by a voice signal generator. This voice signal generator may be either a tape recorder, or it may be a digital voice synthesis circuit. Thus the hearing impaired user can receive a voice announcement of the alarm through his hearing aid. As is the case with the embodiment employing a tone generator, it is desirable for differing voice announcements to be generated corresponding to the differing alarm conditions detected by the base station.

In accordance with an alternative embodiment of the present invention, such a tone generator may be included within the hearing aid unit. In such an event, the base station need only transmit an unmodulated carrier signal. A tone generator at the hearing aid unit generates the audio signal which is heard by the user through the earphone. In such a system, it is preferable to include reset and test logic within the hearing aid unit. Lastly, the portable unit may further include a mechanical vibrator to further alert the user.

BRIEF DESCRIPTION OF THE DRAWINGS

These and other aspects of the present invention will now be described in detail in conjunction with the figures in which.

DETAILED DESCRIPTION OF THE PREFERRED EMBODIMENTS

Figure 1:
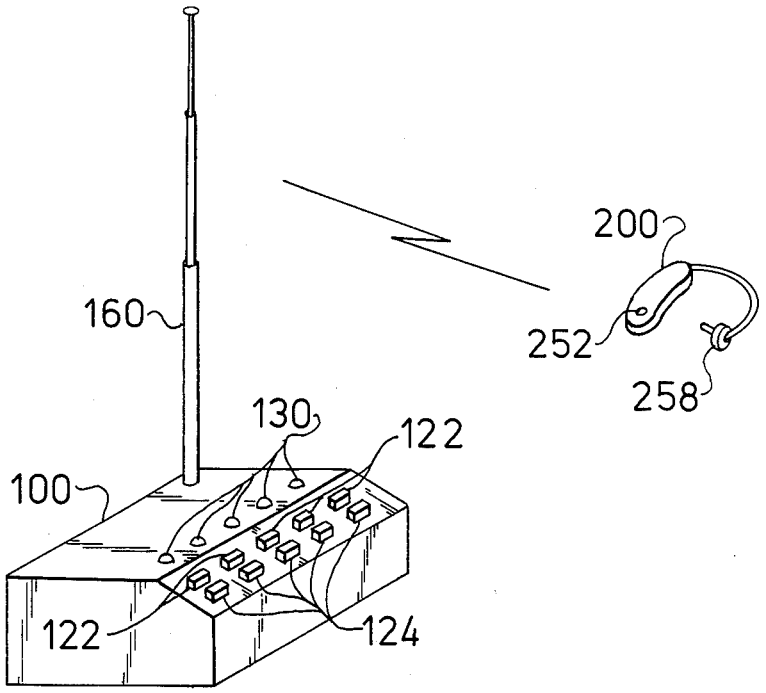
FIG. 1 illustrates the general overall configuration of the two-part alarm system for the hearing impaired in accordance with the present invention.

FIG. 1 illustrates the configuration of the overall alarm system for the hearing impaired in accordance with the present invention. FIG. 1 illustrates base station 100 and portable unit 200.

Base station 100 includes a number of parts. Base station 100 includes a plurality of visual indicators 130. Each visual indicator 130 is associated with a pair of push button switches. The first of these is a reset button 122. The second of these is a test button 124. Base station 100 also includes antenna 160 for transmission of the radio signal.

FIG. 1 also illustrates portable unit 200. portable unit 200 is shown as including opening for microphone 252.

Microphone 252 is employed to detect ambient sound. FIG. 1 also illustrates earphone 258, which is employed to supply the amplified sounds to the hearing impaired user. Although FIG. 1 illustrates portable unit 200 in the form of an over the ear hearing aid, this is not required. Portable unit 200 could be embodied in a hearing aid of the in the ear type, the eyeglasses type or of the separate amplifier type.

Figure 2:
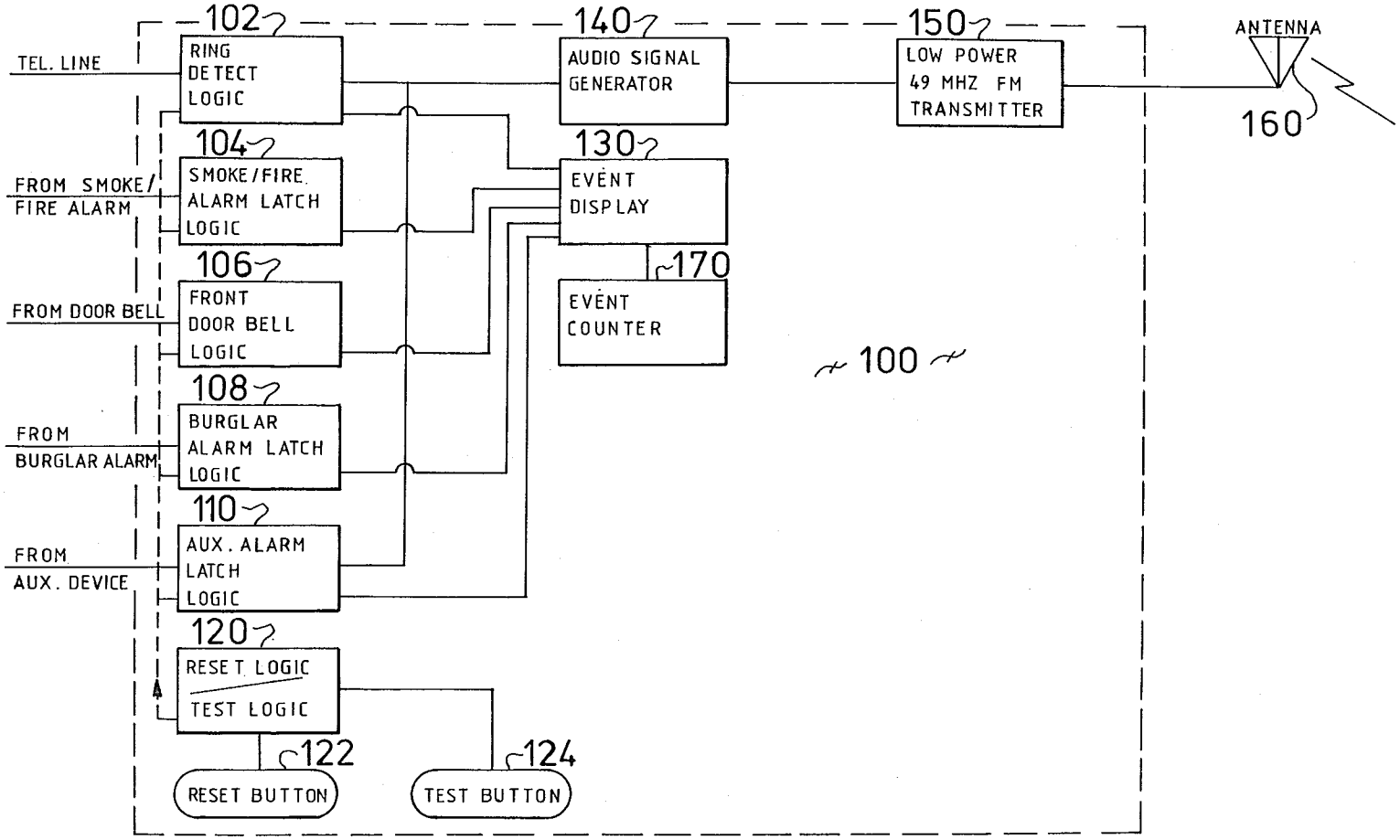
FIG. 2 illustrates a block diagram of the base station in accordance with the preferred embodiment of the present invention.

FIG. 2 illustrates a block diagram of base station 100. Base station 100 is attached to a number of alarm originating lines. These alarm originating lines include a telephone line, a smoke and/or fire alarm, a doorbell, a burglar alarm and an auxiliary device. Each of these incoming lines is connected to a logic circuit for receiving the alarm. The telephone line is connected to ring detect logic 102. The smoke/fire alarm is connected to smoke/fire alarm latch logic 104. The doorbell is attached to front doorbell logic 106. The burglar alarm is attached to burglar alarm latch logic 108. Lastly, the auxiliary device is connected to auxiliary alarm latch logic 110.

Each of these logic circuits is connected in turn to another set of circuits. Firstly, each of these logic circuits is connected to reset logic/test logic 120. Reset logic/test logic 120 is further connected to the reset buttons 122 and the test buttons 124. The operation of reset logic/test logic 120 will be fully explained below in conjunction with an explanation of the typical latch logic circuit. Each of these logic circuits is also connected to event display 130. Event display 130 is provided in order to give a visual indication of the actuation of a particular alarm. These could employ light emitting diodes or a liquid crystal display. Lastly, each of these logic circuits is connected to tone/voice generator 140.

Audio signal generator 140 provides the generation of an audio signal indicative of the receipt of an alarm. This audio signal is coupled to low power FM transmitter 150. In accordance with the preferred embodiment this transmitter operates in the 49 Megahertz band. The radio frequency output of low power FM transmitter 150 is connected to antenna 160 for broadcast to the portable unit 200.

Base station 100 further includes event counter 170. Event counter 170 is connected to event display 130 and hence to each of the latch logic circuits. Event counter 170 is preferably a microprocessor device which detects and logs the number and type of alarms detected during a predetermined period, such as 24 hours. It is also desirable for this event counter to include a real time clock to store the time each event occurred. This information could be later recalled for review.

Figure 3:
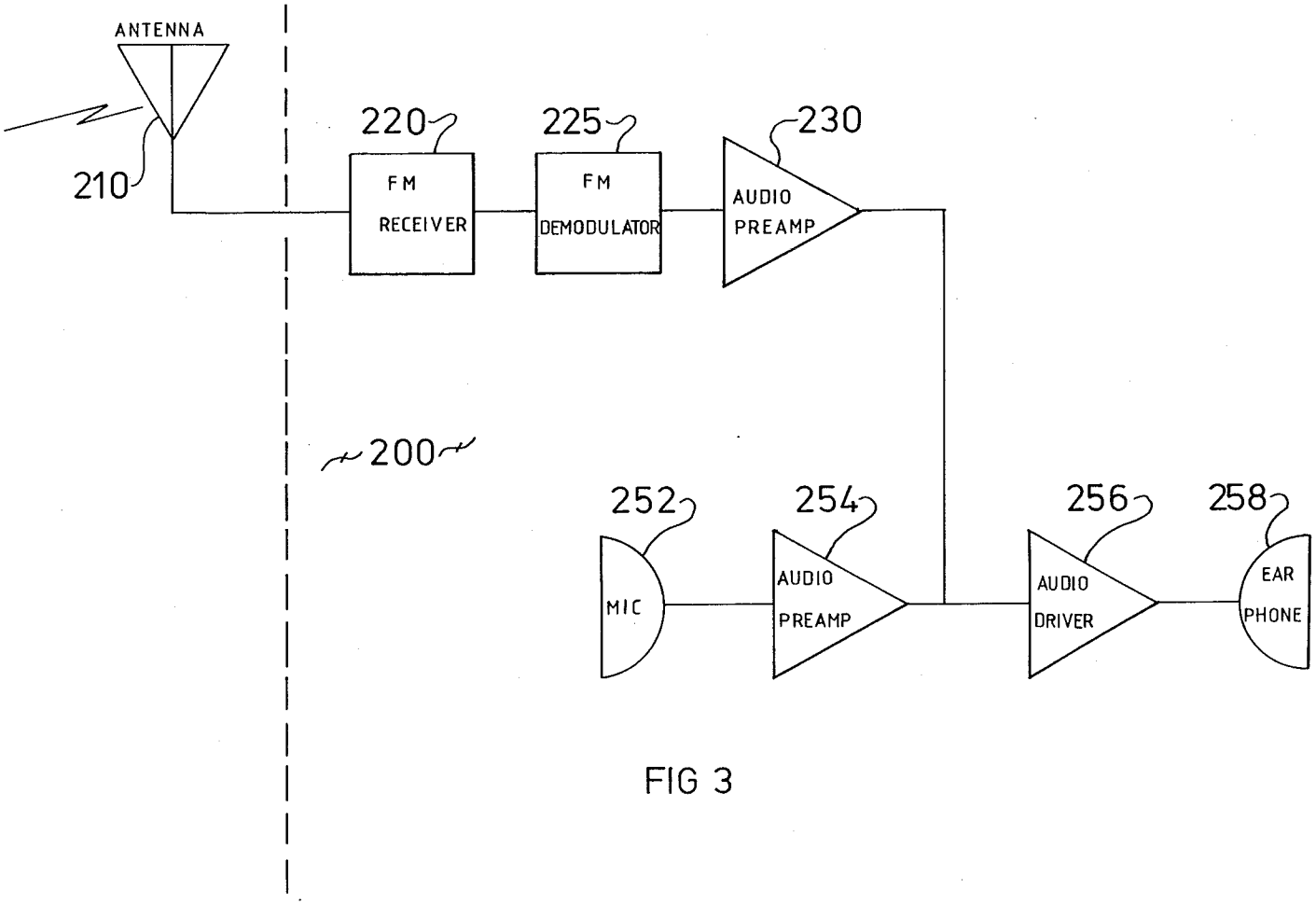
FIG. 3 illustrates a block diagram of the hearing aid portion of the present invention in accordance with the preferred embodiment of the present invention.

FIG. 3 illustrates details of portable unit 200. portable unit 200 includes the parts of a normal hearing aid. These parts include microphone 252, audio preamplifier 254, audio driver 256 and earphone 258. This operates in the normal manner of a hearing aid. Microphone 252 picks up ambient sound at the location of the hearing aid. Audio preamplifier 254 provides audio amplification having the frequency filtering characteristics necessary to correct for the hearing impairment of the user. Audio driver 256 then generates a higher power signal from this preamplified signal. Lastly, earphone 258 provides a sound signal to the ear of the user.

Portable unit 200 further includes a radio receiver portion in accordance with the present invention. This radio receiver includes antenna 210 which receives the broadcast signal from base station 100. This signal is attached to FM receiver 220 which receives this radio frequency signal. FM receiver 220 is connected to FM demodulator 225. FM demodulator 225 recovers the audio signal generated by audio signal generator 140. This audio signal is applied to audio preamplifier 230. The output of audio preamplifier 230 is mixed with the output of audio preamplifier 255 in the audio driver 256. As a result, the sound signal produced by earphone 258 is a combination of the ambient sound received by microphone 252 and the received radio signal.

The alarm system for the hearing impaired of the present invention operates as follows. Upon receipt of a alarm signal from one of the alarm lines connected to base station 100, event display 130 causes a visual indication of the particular alarm received. At the same time, audio signal generator 140 generates an audio signal which is applied to low power FM transmitter 150. This modulated FM signal is radiated via antenna 160.

During normal use of portable unit 200, the unit operates as a normal hearing aid. That is, ambient sound received by microphone 252 is amplified and frequency filtered and applied to earphone 258 for presentation to the user. When low power FM transmitter 150 generates a radio frequency signal, this is received by antenna 210. FM receiver 220 receives this radio frequency signal and amplifies it. FM demodulator 225 recovers the audio signal from the FM carrier and applies it to earphone 258 via audio preamplifier 230 and audio driver 256.

In accordance with the preferred embodiment, audio signal generator 140 generates a differing message depending upon the alarm logic circuit which triggers the alarm. This difference in signal generated allows the user to distinguish the type of alarm received based upon the signal heard via earphone 258. As an example, audio signal generator 140 could generate a signal simulating the ringing of a telephone in response to detection of a ringing signal on the telephone line via ring detect logic circuit 102. Audio signal generator 140 could generate a repeating tone signal in respone to the smoke/fire alarm latch logic circuit. In addition, the audio signal generator 140 could generate a two-tone signal simulating the operation of a dual gong doorbell in response to the front doorbell logic circuit 106. Thus the audio signals generated by audio generator 140 could differ in frequency, amplitude modulation or frequency modulation. The essential point is that audio signals generated by audio signal generator 140 so differ that they are distinguishable by the user. Thus the user is able to determine the type of alarm either by the event display 130 or by the particular audio signal heard via earphone 258.

In accordance with an alternative embodiment of the present invention, audio signal generator 140 could generate a voice signal. In the simple case this voice signal could be the same for each alarm condition. This voice signal could be generated either by a tape recording or by a digital voice synthesis circuit. In accordance with a further embodiment of the present invention, the particular voice signal generated could differ depending upon the type of alarm signal received. A digital voice synthesis circuit could be programmed to generate a differing voice message depending upon the particular logic circuit which generates the alarm. Thus for example the audio signal generator 140 could cause the generation of a voice message indicating which alarm is actuated. As in the case of the generation of tones, this voice signal would be received by hearing aid unit 200 and the voice message would be presented to the user via earphone 258.

Figure 4:
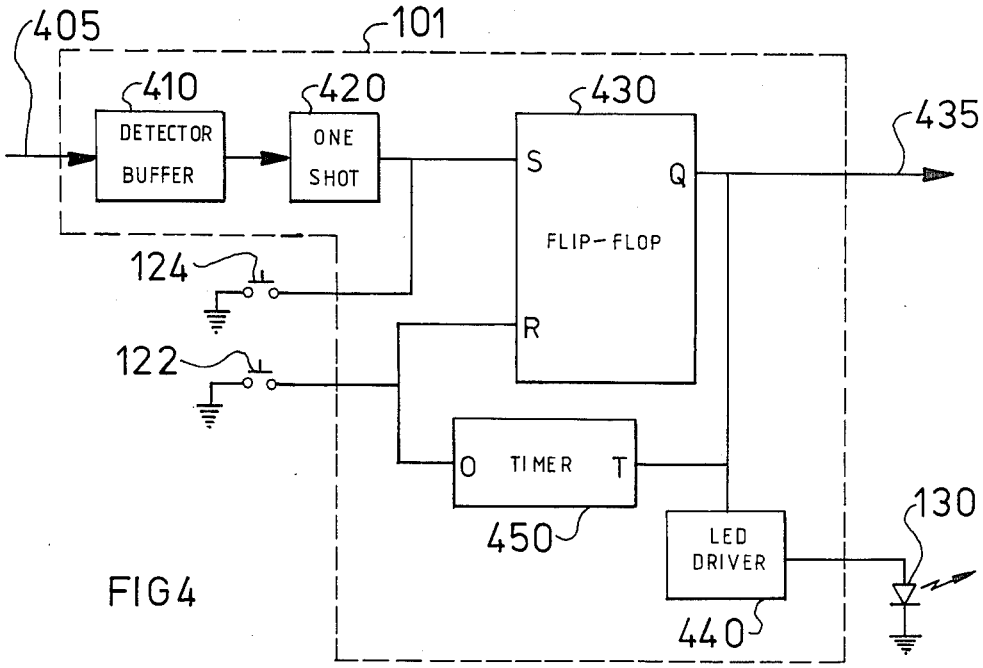
FIG. 4 illustrates a more detailed block diagram of an exemplary one of the latch logic circuits of the base station.

FIG. 4 illustrates a block diagram of a typical alarm latch logic circuit such as smoke/fire alarm latch logic circuit 104, front doorbell logic circuit 106, burglar alarm latch logic circuit 108 and auxiliary alarm latch logic circuit 110. Alarm latch logic circuit 101 illustrated in FIG. 4 includes an alarm input 405, an output 435 to audio signal generator 140 and further connections to reset button 122, test button 124 and event display 130.

Alarm latch logic circuit 101 receives the alarm signal on line 405. This alarm signal on line 405 is connected to a detector/buffer 410. Detector/buffer 410 detects the presense of an alarm signal on line 405, and generates a logic signal of the type used by the other portions of alarm latch logic circuit 101. The output of detector/buffer 410 is applied to one shot circuit 420. One shot circuit 420 provides a single pulse from the indication of the detection of the alarm signal via detector/buffer circuit 410. This single pulse is applied to the set input of flip/flop 430. The output of flip/flop 430 is connected to line 435 which is connected to audio signal generator 140. Thus when flip/flop 430 is set it produces a signal to actuate audio signal generator 140.

Flip/flop 430 includes further connections. Flip/flop 430 is connected to light emitting diode driver circuit 440. Light emitting diode driver circuit 440 is further connected to event display 130 in the form of a light emitting diode. This connection ensures that light emitting diode 130 is illuminated when audio signal generator 140 is actuated. Although a light emitting diode driver is illustrated 440 together with a light emitting diode 130 those skilled in the art would understand that it is equally feasible to provide a driver for a differing kind of visual event display such as a liquid crystal display.

The output of flip/flop circuit 430 is optionally also applied to the trigger input of timer 450. The output of timer 450 is connected to the reset input of flip/flop circuit 430. As thus connected, when triggered, timer 430 generates an output after a predetermined period of time which is applied to the reset input of flip/flop circuit 430. This application of the output of timer 450 to the reset input of flip/flop circuit 430 serves to reset flip/flop circuit 430. As a consequence, the output of flip/flop circuit 430 on line 435 no longer actuates audio signal generator 140. In addition, this output also no longer energizes the LED driver 440 and light emitting diode 130. In accordance with the preferred embodiment of the present invention timer 450 includes a time delay of between 5 and 20 seconds.

Reset button 122 and test button 124 are also connected to flip/flop 430. Reset button 122 is connected to the reset input of flip/flop circuit 430. Upon actuation of reset button 122 a signal is applied to the reset input of flip/flop circuit 430 to place it in its reset state. In this state the audio signal generator 140 and LED driver 440 are no longer actuated.

Test button 124 is connected to the set input of flip/flop circuit 430. Upon actuation of test button 124 a signal is applied to the set input of flip/flop circuit 430. This places flip/flop circuit 430 into its set state, thereby actuating audio signal generator 140 and light emitting diode driver 440. Flip/flop circuit 430 remains in this state until reset by reset button 122 or via timer 450.

Figure 5:
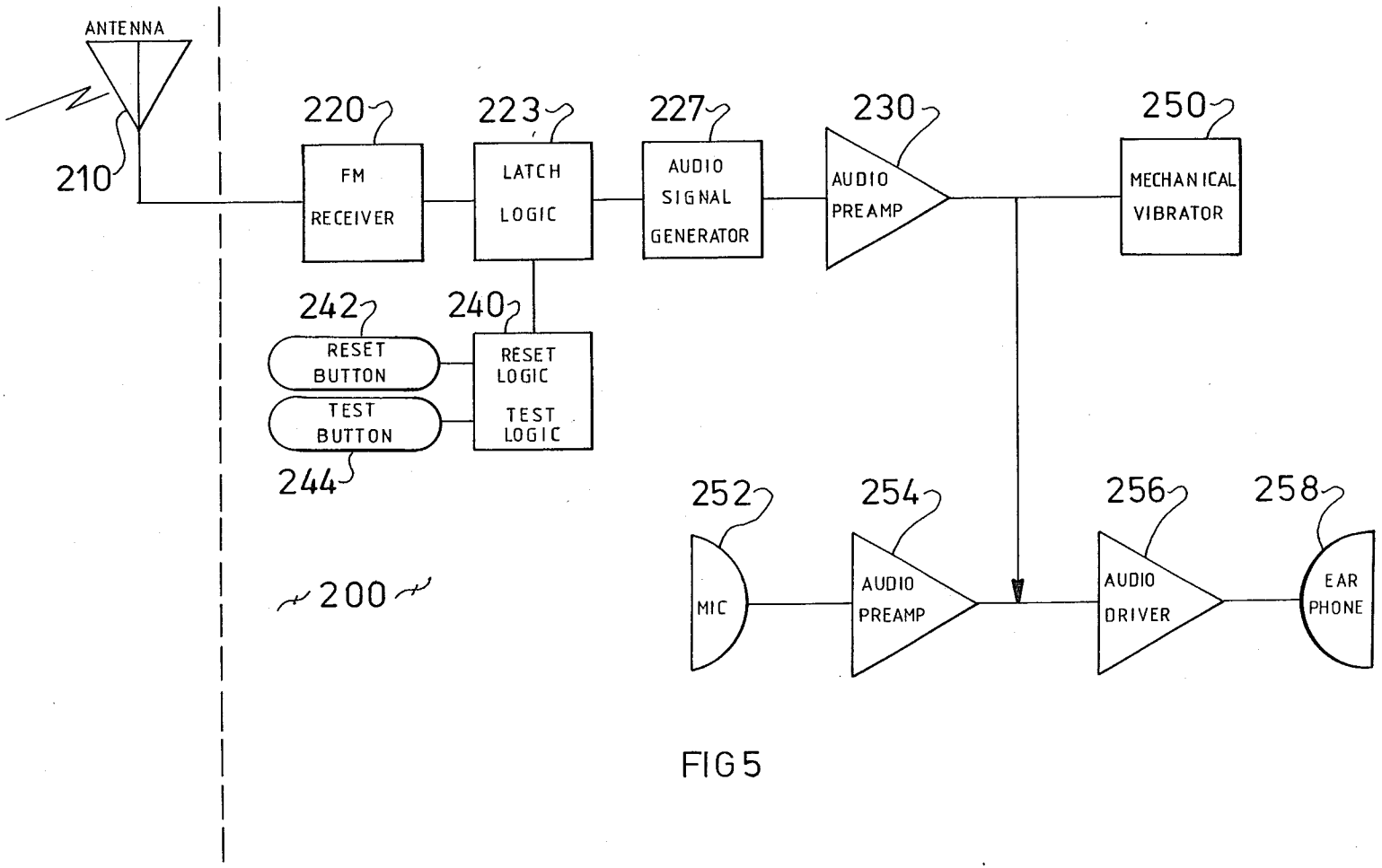
FIG. 5 illustrates a block diagram of the hearing aid portion of the alarm system of the present invention in accordance with an alternative embodiment.

FIG. 5 illustrates an alternative embodiment of the portable unit 200 of the present invention. In accordance with the alternative embodiment illustrated in FIG. 5, an audio signal generator is included with in portable unit 200 of the present invention.

Many parts of the hearing aid portion illustrated in FIG. 5 are similar to that previously illustrated in FIG. 3. In particular, the hearing aid portion includes a microphone 252, audio preamplifier 254, audio driver 256 and earphone 258 is the same as that previously illustrated in FIG. 3. FIG. 5 illustrates antenna 210 and FM receiver 220 in the same manner previously illustrated in FIG. 3. The FM receiver 220 is coupled to latch logic circuit 223. Latch logic circuit 223 is also connected to reset logic/test logic circuit 240. This combination is similar to the combination of smoke/fire alarm latch logic circuit 104, front doorbell logic circuit 106, burglar alarm latch logic circuit 108 or auxiliary alarm latch logic circuit 110 and reset logic/test logic circuit 120. Reset logic/test logic 240 is connected to reset button 242 and test button 244. Reset button 242 is similar to reset button 122 illustrated in FIG. 2. Likewise, test button 244 is similar to test button 124 illustrated in FIG. 2.

Latch logic circuit 223 could be constructed in a manner similar to latch logic circuit 101 illustrated in FIG. 4. The output of latch logic circuit 223 is coupled to audio signal generator 227 and event display 246. Audio signal generator 227 is similar to audio signal generator 140. The output of audio signal generator 227 is applied to audio preamplifier 230 and hence to audio driver 256 where it is mixed with the signal from audio preamplifier 254.

In operation the portable unit 200 illustrated in FIG. 5 generates the alarm signal rather than its being generated at the base station 100. Upon receipt of the FM signal from transmitter 150 via antenna 210, FM receiver 220 triggers the latch logic circuit 223. Latch logic circuit 223 enables generation of an audio signal by audio signal generator 227 and an event display by event display 246 in the manner similar to that disclosed above in conjunction with FIG. 2. In this case, audio signal generator 227 generates a single audio signal to indicate any of the alarm signals such as those illustrated in FIG. 2. In other aspects, the alternative embodiment illustrated in FIG. 5 operates in the manner previously disclosed. In particular, the latch logic circuit 223 can be reset via reset button 242. In addition, the latch logic 223, the audio signal generator 227 and the event display 246 may be tested via test button 244. The operation of these two buttons is similar to that previously disclosed in conjunction with FIG. 4.

The portable unit 200 further includes mechanical vibrator 250. Mechanical vibrator 250 is activated when an alarm signal is received and generates a vibration which can be felt by the user. This serves as an alternative alerting mechanism.

It can be seen from the foregoing description of the present invention, that the present invention enables a hearing impaired person to be alerted to various alarm conditions via a portable unit including a hearing aid. This invention is believed advantageous over other alert systems for hearing impaired persons because the alarm signal is generated in the earphone of the hearing aid unit. Therefore, in the case of the present invention it is believed that there is a greater probability that the hearing impaired person will detect and respond to the alarm.

What is claimed is:

1. An alarm apparatus for a hearing impaired person comprising:

a base station unit including at least one alarm receiving circuit adapted to receive an alarm signal, at least one indicator, each indicator connected to a corresponding alarm receiving circuit for generating a visual indication of the receipt of an alarm signal by said corresponding alarm receiving circuit, and a transmitter connected to said at least one alarm receiving circuit for generating an electromagnetic signal upon receipt of an alarm signal by any of said at least one alarm receiving circuits; and a portable unit adapted to be carried by the hearing impaired person including a microphone for generating a microphone audio signal corresponding to received acoustic energy, a receiver for generating an alarm audio signal upon receipt of said electromagnetic signal from said transmitter, a mixing amplifier connected to said microphone and said receiver and having an output, for mixing said microphone audio signal and said alarm audio signal and amplifying said mixed microphone and alarm audio signal, said mixing amplifier having gain and frequency characteristics to compensate for the impairment of the hearing impaired person, and an earphone connected to the output of said mixing amplifier for generating acoustic energy corresponding to the signal at the output of said mixing amplifier.

2. The alarm apparatus as claimed in claim 1, wherein:

said at least one alarm receiving circuit includes a latch circuit having first and second stable states, said latch circuit normally in said first stable state for entering said second stable state upon receipt of an alarm signal and remaining in said second stable state until reset and a reset circuit for resetting said latch circuit to said first stable state upon receipt of an operator reset input;

said at least one indicator being connected to said latch circuit for generating said visual indication only when said latch circuit is in said second stable state, and said transmitter being connected to said latch circuit of each of said at least one alarm receiving circuit for generating said electromagnetic signal only when at least one latch circuit is in said second stable state.

3. The alarm apparatus as claimed in claim 2, wherein:

said reset circuit includes a manually actuable reset switch corresponding to each of said at least on alarm receiving circuit and disposed in physical proximity with said corresponding indicator.

4. The alarm apparatus as claimed in claim 2, wherein:

said at least one alarm receiving circuit further includes a reset timer circuit connected to said latch circuit for resetting said latch circuit to said first stable state a predetermined period of time after said latch circuit enters said second stable state.

5. The alarm apparatus as claimed in claim 4, wherein:

said predetermined period of time is in the range of 5 to 20 seconds.

6. The alarm apparatus as claimed in claim 1, wherein:

said base station unit further includes a tone generator connected to said at least one alarm receiving circuit for generating an audio tone signal upon receipt of an alarm signal, and a modulator connected to said tone generator and said transmitter for modulating said electromagnetic signal in accordance with said audio tone signal generated by said tone generator; and said portable unit further includes a demodulator connected to said receiver and said mixing amplifier for demodulating said audio tone signal modulating said electromagnetic signal and applying said audio tone signal to said mixing amplifier.

7. The alarm apparatus as claimed in claim 6, wherein:

said base station unit includes a plurality of alarm receiving circuits, said tone generator generating a unique audio tone signal upon receipt of an alarm signal by a particular alarm receiving circuit whereby the hearing impaired person can distinguish the type of alarm signal received based upon the unique audio tone signal.

8. The alarm apparatus as claimed in claim 7, wherein said unique audio tone signals differ in frequency.

9. The alarm apparatus as claimed in claim 7 wherein said unique audio tone signals differ in amplitude modulation character.

10. The alarm apparatus as claimed in claim 7, wherein said unique audio tone signals differ in frequency modulation character.

11. The alarm apparatus as claimed in claim 1, wherein:

said portable unit further includes a tone generator connected to said receiver and said mixing amplifier for generating an audio tone signal upon receipt of said electromagnetic signal and applying said audio tone signal to said mixing amplifier.

12. The alarm apparatus as claimed in claim 11, wherein:

said portable unit further includes a latch circuit for connecting said receiver and said tone generator having first and second stable states, said latch circuit normally in said first stable state, for entering said second stable state upon receipt of said electromagnetic signal and remaining in said second stable state until reset, said tone generator being energized only when said latch circuit is in said second state, and a reset circuit for resetting said latch circuit to said first stable state upon receipt of an operator reset input.

13. The alarm apparatus as claimed in claim 1, wherein:

said base station unit further includes a voice signal generator connected to said at least one alarm receiving circuit for generating a voice signal corresponding to a voice alarm announcement upon receipt of an alarm signal, and a modulator connected to said voice signal generator and said transmitter for modulating said electromagnetic signal in accordance with said voice signal generated by said voice signal generator; and said portable unit further includes a demodulator connected to said receiver and said mixing amplifier for demodulating said voice signal modulating said electromagnetic signal and applying said voice signal to said mixing amplifier.

14. The alarm apparatus as claimed in claim 13, wherein:

said base station unit includes a plurality of alarm receiving circuits, said voice signal generator generating a voice signal consisting of unique voice alarm upon receipt of an alarm signal by a particular alarm receiving circuit, whereby the hearing impaired person can distinguish the type of alarm signal received based upon the unique voice signal.

15. The alarm apparatus as claimed in claim 13, wherein:

said voice signal generator consists of a tape recorder.

16. The alarm apparatus as claimed in claim 13, wherein:

said voice signal generator consists of a synthetic voice signal generator.

17. The alarm apparatus as claimed in claim 1, wherein:

said portable unit further includes a voice signal generator connected to said receiver and said mixing amplifier for generating a voice signal corresponding to a voice alarm announcement upon receipt of said electromagnetic signal and applying said voice signal to said mixing amplifier.

18. The alarm apparatus as claimed in claim 1, wherein:

said base station unit further includes a manually actuable alarm test circuit connecting to said at least one alarm receiving circuit for simulating the receipt of an alarm signal for testing the alarm apparatus.

19. The alarm apparatus as claimed in claim 1, wherein:

said base unit further includes a ring detecting circuit connected to one of said at least one alarm receiving circuit and adapted for connection to a telephone subscriber line for generating an alarm signal upon detection of a ring signal on the telephone subscriber line.

20. The alarm apparatus as claimed in claim 1, wherein:

said portable unit further includes a mechanical vibrator connected to said receiver for generating tactilely perceivable indication upon receipt of said electromagnetic signal.

21. The alarm apparatus as claimed in claim 1, further comprising:

an event counter device connected to said at least one alarm receiving circuit for counting the number of alarm signals received by respective alarm receiving circuits during a predetermined period of time.

22. The alarm apparatus as claimed in claim 21, wherein:

said event counter device further includes a clock device for specifying the current time and an event memory for storing in said event memory the time specified by said clock upon receipt of each alarm.

23. An alarm apparatus portable unit adapted to be carried by a hearing impaired person comprising:

a microphone for generating a microphone audio signal corresponding to received acoustic energy;

a receiver for receiving an electromagnetic signal from a transmitter;

a tone generator connected to said receiver for generating an audio tone signal upon receipt of said electromagnetic signal by said receiver;

a mixing amplifier connected to said microphone and said tone generator and having an output, for amplifying and mixing said microphone audio signal and said audio tone signal, said mixing amplifier having gain and frequency characteristics to compensate for the impairment of the hearing impaired person; and an earphone connected to said mixing amplifier for generating acoustic energy corresponding to said output of said mixing amplifier.

* * * * *